US006380691B2

(12) United States Patent
Eo

(10) Patent No.: US 6,380,691 B2
(45) Date of Patent: Apr. 30, 2002

(54) 4-ELECTRODES TYPE PLASMA DISPLAY PANEL, DRIVE METHOD AND APPARATUS THEREFOR

(75) Inventor: Yoon-phil Eo, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/778,870

(22) Filed: Feb. 8, 2001

(30) Foreign Application Priority Data

Feb. 9, 2000 (KR) ..... 00-5970

(51) Int. Cl.[7] ..... G09G 3/10

(52) U.S. Cl. ..... 315/169.4; 315/169.1; 345/68; 345/80; 313/581

(58) Field of Search ..... 315/169.1, 169.2, 315/169.4; 345/55, 60, 67, 68, 80; 313/581, 492, 582, 584–587

(56) References Cited

U.S. PATENT DOCUMENTS 6,097,149 A * 8/2000 Miyaji et al. ..... 313/582
6,249,264 B1 * 6/2001 Sano et al. ..... 313/582
6,266,033 B1 * 7/2001 Kim ..... 313/492
6,276,980 B1 * 8/2001 Kim ..... 427/125
6,281,633 B1 * 8/2001 Lee et al. ..... 315/169.1
6,329,751 B2 * 12/2001 Yoo ..... 313/582

* cited by examiner

*Primary Examiner*—Haissa Philogene
(74) *Attorney, Agent, or Firm*—Staas & Halsey LLP

(57) ABSTRACT

A plasma display panel includes a front glass substrate, a rear glass substrate, address electrode lines, a first dielectric layer, scan electrode lines, a second dielectric layer, phosphor layers, Y-common electrode lines and X-common electrode lines. The front glass substrate and a rear glass substrate are opposite to and spaced apart from each other. The address electrode lines are formed on the front surface of the rear glass substrate in parallel. The first dielectric layer is formed in front of the address electrode lines. The scan electrode lines are arranged in front of the first dielectric layer to be perpendicular to the address electrode lines to define discharge cells at intersections. The second dielectric layer is formed in front of the scan electrode lines. The phosphor layers are formed in front of the second dielectric layer to be parallel with the address electrode lines. The Y-common electrode lines and X-common electrode lines are alternately arranged on the rear surface of the front glass substrate with the scan electrode lines interposed therebetween.

10 Claims, 9 Drawing Sheets

SF1
A1
S1
A11
A12
A13
A14

SA
VA
0 [V]

Sx
VRX
VXB
VS
0 [V]

SY1
VS
VYB
VS
0 [V]

SY2
0 [V]

SYn
0 [V]
VOLTAGE
TIME

SF1
A1
S1
R1
MA1
SA1

SA
VA
VA
0[V]

SYC
VS
VS
0[V]

SXC
VS
0[V]

SS1
VS
VA
0[V]
-Vr

SS2
VS
VA
0[V]
-VY

SSn
VS
VA
0[V]
-V Y
VOLTAGE
TIME

4-ELECTRODES TYPE PLASMA DISPLAY PANEL, DRIVE METHOD AND APPARATUS THEREFOR

CROSS-REFERENCE TO RELATED APPLICATIONS

This application claims the benefit of Korean Application No. 00-5970, filed Feb. 9, 2000, in the Korean Industrial Property Office, the disclosure of which is incorporated herein by reference.

BACKGROUND OF THE INVENTION

1. Field of the Invention

The present invention relates to a plasma display panel, and more particularly, to a surface-discharge alternating-current plasma display panel, a drive method and apparatus therefor.

2. Description of the Related Art

FIG. 1 shows a general three-electrode surface-discharge alternating-current plasma display panel. Address electrode lines $A_{R1}, A_{G1}, \ldots, A_{Gm}, A_{Bm}$, dielectric layers 11 and 15, Y electrode lines $Y_1, \ldots, Y_n$, X electrode lines $X_1, \ldots, X_n$, a phosphor layer 16, barrier ribs 17 and a MgO protective film 12 are provided between front and rear glass substrates 10 and 13 of a general surface-discharge plasma display panel 1.

The address electrode lines $A_{R1}, A_{G1}, \ldots, A_{Gm}, A_{Bm}$ are formed on the front surface of the rear glass substrate 13 in a predetermined pattern. The dielectric layer 15 is entirely formed in front of the address electrode lines $A_{R1}, A_{G1}, \ldots, A_{Gm}, A_{Bm}$, so as to cover the address electrodes $A_{R1}, A_{G1}, \ldots, A_{Gm}, A_{Bm}$. The barrier ribs 17 are formed in front of the dielectric layer 15 to be parallel with the address electrode lines $A_{R1}, A_{G1}, \ldots, A_{Gm}, A_{Bm}$. The partition walls formed by the barrier ribs 17 define discharge areas of the respective discharge cells and prevent cross talk between each of the respective discharge cells. The phosphor layers 16 are formed between the barrier ribs 17.

The X electrode lines $X_1, \ldots, X_n$ and the Y electrode lines $Y_1, \ldots, Y_n$, are formed on the rear surface of the front glass substrate 10 in a predetermined pattern to be perpendicular to the address electrode lines $AR_1, A_{G1}, \ldots, A_{Gm}, A_{Bm}$. The respective intersections define corresponding pixels. The MgO protective film 12 for protecting the plasma display panel 1 against a strong electric field is formed on the rear surface of the dielectric layer 11. A gas for forming plasma is hermetically sealed in a discharge space 14.

FIGS. 2A–2E show driving signals applied to the plasma display panel 1 shown in FIG. 1. Specifically, $S_A$ (FIG. 2A) denotes driving signals applied to the respective address electrode lines ($A_{R1}, A_G$1, . . . , $A_{Gm}, A_{Bm}$ of FIG. 1), $S_x$ (FIG. 2B) denotes driving signals applied to the X electrode lines ($X_1, \ldots, X_n$ of FIG. 1), and $S_{Y1}, \ldots, S_{Yn}$ (FIGS. 2C–2E) denote driving signals applied to the Y electrode lines ($Y_1, \ldots, Y_n$ of FIG. 1), respectively. An address period A1 in a unit subfield SF1 is divided into reset periods A11, A12 and A13 and a main address period A14.

During a display discharge period S1, a common pulse of a voltage $V_S$, which is higher than a positive voltage $V_{XB}$, is alternately applied to all of Y electrode lines $Y_1, \ldots, Y_n$ and the X electrode lines $X_1, \ldots, X_n$ so that display discharges occur at discharge cells where wall charges were formed during the corresponding address period A1. In the case where the last pulse is applied to the X electrode lines $X_1, \ldots, X_n$ during the display discharge period S1, electrons are formed in the vicinity of the X electrode lines of selected displayed discharge cells and positive charges are formed in the vicinity of Y electrode lines. Accordingly, during the first reset period A11, a voltage $V_{RX}$ lower than the positive voltage $V_{XB}$ is applied to the X electrode lines $X_1, \ldots, X_n$, thereby performing a discharge in which the wall charges are primarily erased. Also, during the second reset period A12, a narrow-width voltage of the $V_S$ is applied to the Y electrode lines $Y_1, \ldots, Y_n$, thereby performing a discharge in which the remaining wall charges are secondarily erased. Finally, during the third reset period A13, the voltage $V_{RX}$ is again applied to the X electrode lines $X_1, \ldots, X_n$, thereby performing a discharge in which the wall charges are finally erased. Accordingly, all of the wall charges can be erased from the discharge space, and space charges can be uniformly distributed throughout the discharge space.

During the main address period A14, display data signals are applied to the address electrode lines $A_{R1}, A_{G1}, \ldots, A_{Gm}, A_{Bm}$, and simultaneously the corresponding scan pulses are sequentially applied to the Y electrode lines $Y_1, \ldots, Y_n$. The display data signals applied to the address electrode lines $A_{R1}, A_G$1, . . . , $A_{Gm}, A_{Bm}$ are a positive voltage Va in the case where a discharge cell is selected, and a ground voltage, i.e., 0 volts, in the case where a discharge cell is not selected. A bias voltage $V_{RX}$ is applied to the respective Y electrode lines $Y_1, \ldots, Y_n$ during a scanning time, and 0 volts are applied thereto during a non-scanning time. Accordingly, if a display data signal of Va is applied while a scan pulse of 0 volts is applied, wall charges are formed by address discharge at the corresponding discharge cell. Otherwise, wall charges are not formed at the other discharge cells. Here, for more accurate and effective address discharge, a voltage $V_{XB}$ lower than $V_S$ and higher than $V_{YB}$ is applied to the X electrode lines $X_1, \ldots, X_n$.

FIG. 3 shows a driving apparatus for generating the driving signals shown in FIGS. 2A–2E. The driving apparatus of the conventional 3-electrode plasma display panel 1 includes a controller 32, an address driver 33, an X driver 34 and a Y driver 35. The controller 32 generates driving control signals $S_{CA}$, $S_{CY}$ and $S_{CX}$ in accordance with a video signal externally applied. The address driver 33 processes the address driving control signal $S_{CA}$ among the driving control signals $S_{CA}$, $S_{CY}$ and $S_{CX}$ generated by the controller 32 to generate a display data signal ($S_A$ of FIG. 2A), and applies the generated display data signal $S_A$ to the address electrode lines $A_{R1}, A_{G1}, \ldots, A_{Gm}, A_{Bm}$. The X driver 34 processes the X driving control signal SCX among the driving control signals $S_{CA}$, $S_{CY}$ and $S_{CX}$ generated by the controller 32 to generate an X driving signal ($S_X$ FIG. 2B), and applies the generated X driving signal $S_X$ to the X electrode lines $X_1, \ldots, X_n$.

The Y driver 35 processes the Y driving control signal $S_{CY}$ among the driving control signals $S_{CA}$, $S_{CY}$ and $S_{CX}$ generated by the controller 32 to generate Y driving signals ($S_{Y1}$, $S_{Y2} \ldots, S_{Yn}$ of FIGS. 2C–E), and applies the same to the Y electrode lines $Y_1, \ldots, Y_n$. The Y driver 35 is divided into a scan driver 351 and a Y-common driver 352. The scan driver 351 outputs its driving signals during an address period (A1 of FIGS. 2A–E) only, and the Y-common driver 352 outputs its driving signals during the display discharge period (S1) only. The Y electrode lines $Y_1, \ldots, Y_n$ of the conventional 3-electrode plasma display panel 1 must be driven during the display discharge period S1 as well as the address period A1. Thus, the respective output ports of the Y-common driver 352 must be connected with the corresponding output ports of the scan driver 351. Also, in order to uniformly control the respective driving timings by switching, the unit circuits of the Y-common driver 352 and the scan driver 351 for driving the Y electrode lines $Y_1, \ldots, Y_n$ must be connected to each other. Therefore, the Y-common driver 352 and the scan driver 351 require many components. Also, many elements are required for separating or switching the Y-common driver 352 and the scan driver 351. Thus, the scan driver 351 of the conventional driving apparatus consumes much power and emits a large amount of heat.

A driving apparatus of a plasma display panel consuming a high amount of power must have power regeneration circuits. The power regeneration circuits are provided in the Y-common driver 352 and the X driver 34. In other words, in the display discharge period (S1 of FIGS. 2A–E), the Y-common driver 352 and the X-driver 34 withdraw any unnecessary power from discharge cells displayed in the current pulse period when the pulse of $V_S$ for display discharge is applied to the X electrode lines $X_1, \ldots, X_n$ and the Y electrode lines $Y_1, \ldots, Y_n$, and apply the withdrawn power to discharge cells to be displayed in a subsequent pulse period. However, since many elements are required for isolating or switching the components of the Y-common driver 352 and the X-driver 34 and unit circuits thereof, power consumption increases, which causes a reduction in the power regeneration efficiency of the Y-common driver 352.

As described above, according to the conventional three-electrode plasma display panel 1, the Y electrode lines $Y_1, \ldots, Y_n$ must be driven during the display discharge period S1 as well as during the address period A1. Accordingly, power consumption and heat emission of the plasma display panel itself and the driving apparatus thereof increase.

SUMMARY OF THE INVENTION

To solve the above and other problems, it is an object of the present invention to provide a plasma display panel which can increase the power regeneration efficiency and can reduce power consumption and heat emission.

Additional objects and advantages of the invention will be set forth in part in the description which follows and, in part, will be obvious from the description, or may be learned by practice of the invention.

Accordingly, to achieve the above and other objects, there is provided a plasma display panel according to an embodiment of the present invention including a front glass substrate, a rear glass substrate, address electrode lines, a first dielectric layer, scan electrode lines, a second dielectric layer, phosphor layers, Y-common electrode lines and X-common electrode lines.

In the embodiment of the present invention, the front glass substrate and a rear glass substrate are opposite to and spaced apart from each other; the address electrode lines are formed on the front surface of the rear glass substrate in parallel; the first dielectric layer is formed in front of the address electrode lines; the scan electrode lines are arranged in front of the first dielectric layer to be perpendicular to the address electrode lines to define discharge cells at intersections; the second dielectric layer is formed in front of the scan electrode lines; the phosphor layers are formed in front of the second dielectric layer to be parallel with the address electrode lines; and the Y-common electrode lines and X-common electrode lines are alternately arranged on the rear surface of the front glass substrate with the scan electrode lines interposed therebetween. The address electrode lines and the scan electrode lines are driven to select discharge cells to be displayed, and the Y-common electrode lines and the X-common electrode lines are driven to display selected discharge cells. Accordingly, since the scan electrode lines and the Y-common electrodes lines can be independently driven, the power regeneration efficiency of the plasma display panel can be enhanced, and the power consumption and heat emission of the driving apparatus thereof can be reduced.

According to another embodiment of the present invention, a method of driving the plasma display panel includes forming wall charges in front of the phosphor layers of the selected discharge cells while a scan pulse is sequentially applied to the scan electrode lines and the corresponding display data signal is applied to the address electrode lines; producing abundant space charges in the selected discharge cells by causing the formed wall charges to migrate toward the Y-common electrode lines and X-common electrode lines; causing a display discharge after the space charges are produced, by applying a pulse for display discharge alternately to the Y-common electrode lines and the X-common electrode lines to cause display discharges to be performed at discharge cells where abundant wall charges are formed; after causing the display discharge, uniformly distributing the space charges of all discharge cells while erasing the wall charges present around the Y-common electrodes and X-common electrodes of the discharge cells where the display discharges have been performed; and repeating the forming wall charges, producing abundant space charges, causing the display discharge, distributing the space charges.

According to a still farther embodiment of the present invention, an apparatus to drive the plasma display panel includes a controller to generate driving control signals in accordance with an external video signal; an address driver to process an address driving control signal among the driving control signals generated by the controller and applying the display data signals to the address electrode lines; an X-common driver to drive the X-common electrode lines in accordance with an X driving control signal among the driving control signals generated by the controller; a scan driver to drive the scan electrode lines in accordance with a Y driving control signal among the driving control signals generated by the controller; and a Y-common driver to drive the Y-common electrode lines in accordance with the Y driving control signal. According to the driving apparatus of the present invention, since the scan electrode lines and the Y-common electrodes lines can be independently driven, the number of elements of the scan electrode lines and the Y-common electrode lines can be reduced and the connection elements thereof can be eliminated. Accordingly, the power consumption of the scan electrode lines and the Y-common electrodes lines can be reduced, thereby increasing the power regeneration efficiency of the Y-common driver.

BRIEF DESCRIPTION OF THE DRAWINGS

The above objectives and advantages of the present invention will become more apparent by describing in detail a preferred embodiment thereof with reference to the attached drawings in which.

DETAILED DESCRIPTION OF THE PREFERRED EMBODIMENTS

Figure 1:
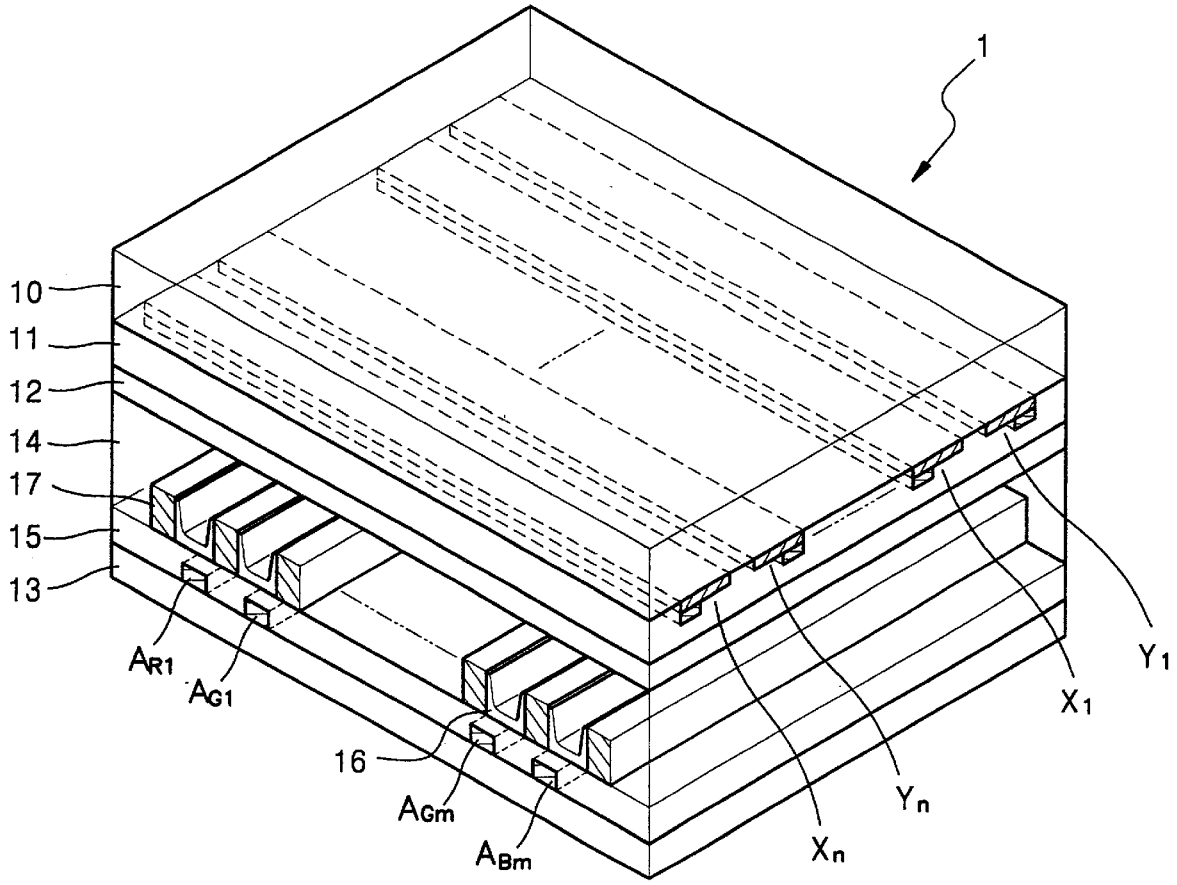
FIG. 1 (PRIOR ART)
FIG. 1 is an internal perspective view showing the structure of a conventional three-electrode surface-discharge alternating-current plasma display panel.
Figures 2A, 2B, 2C, 2D, 2E:
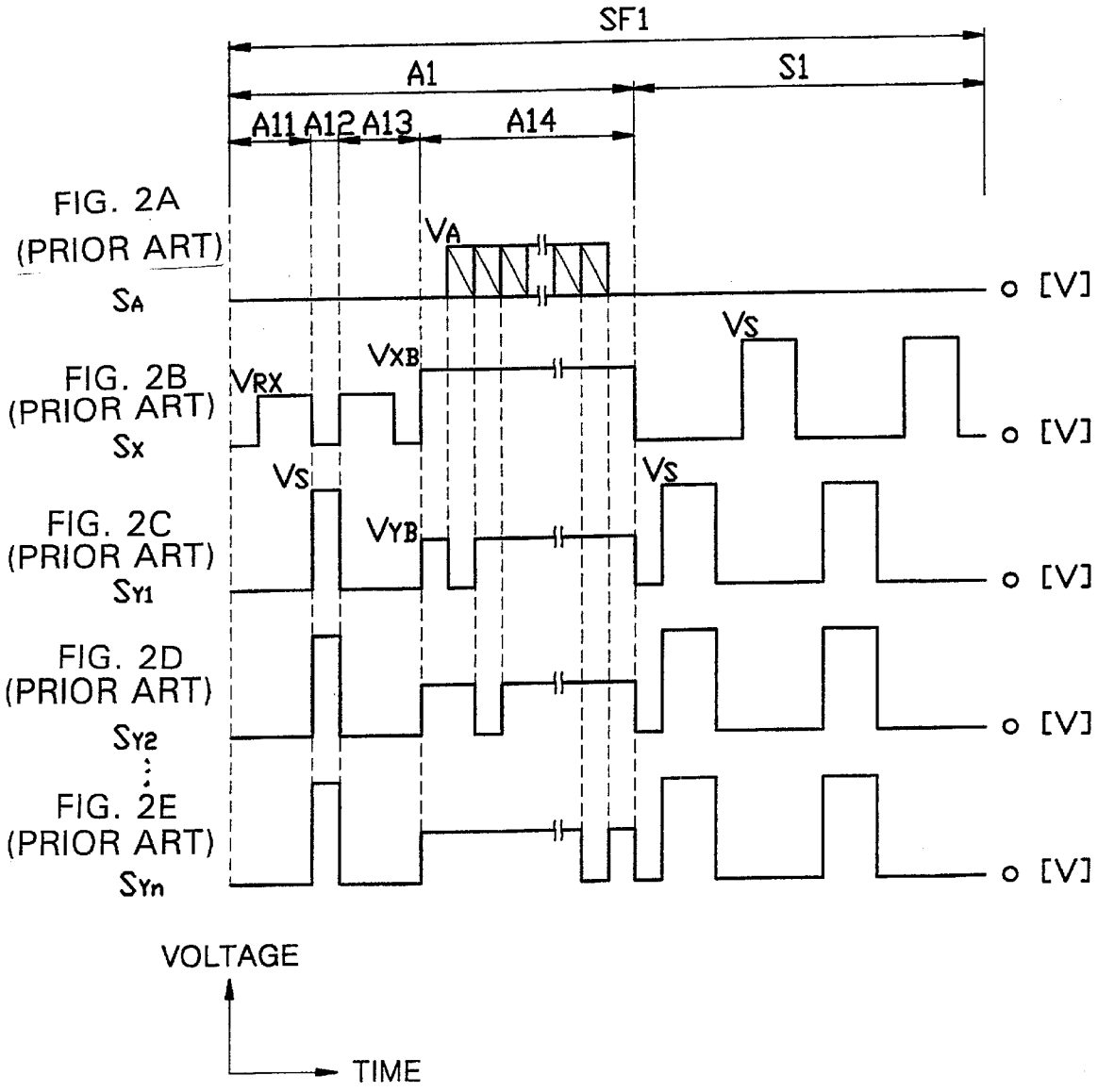
FIG. 2A (PRIOR ART)
FIG. 2B (PRIOR ART)
FIG. 2C (PRIOR ART)
FIG. 2D (PRIOR ART)
FIG. 2E (PRIOR ART)
FIGS. 2A–2E are timing diagrams showing driving signals of the conventional plasma display panel shown in FIG. 1.
Figure 3:
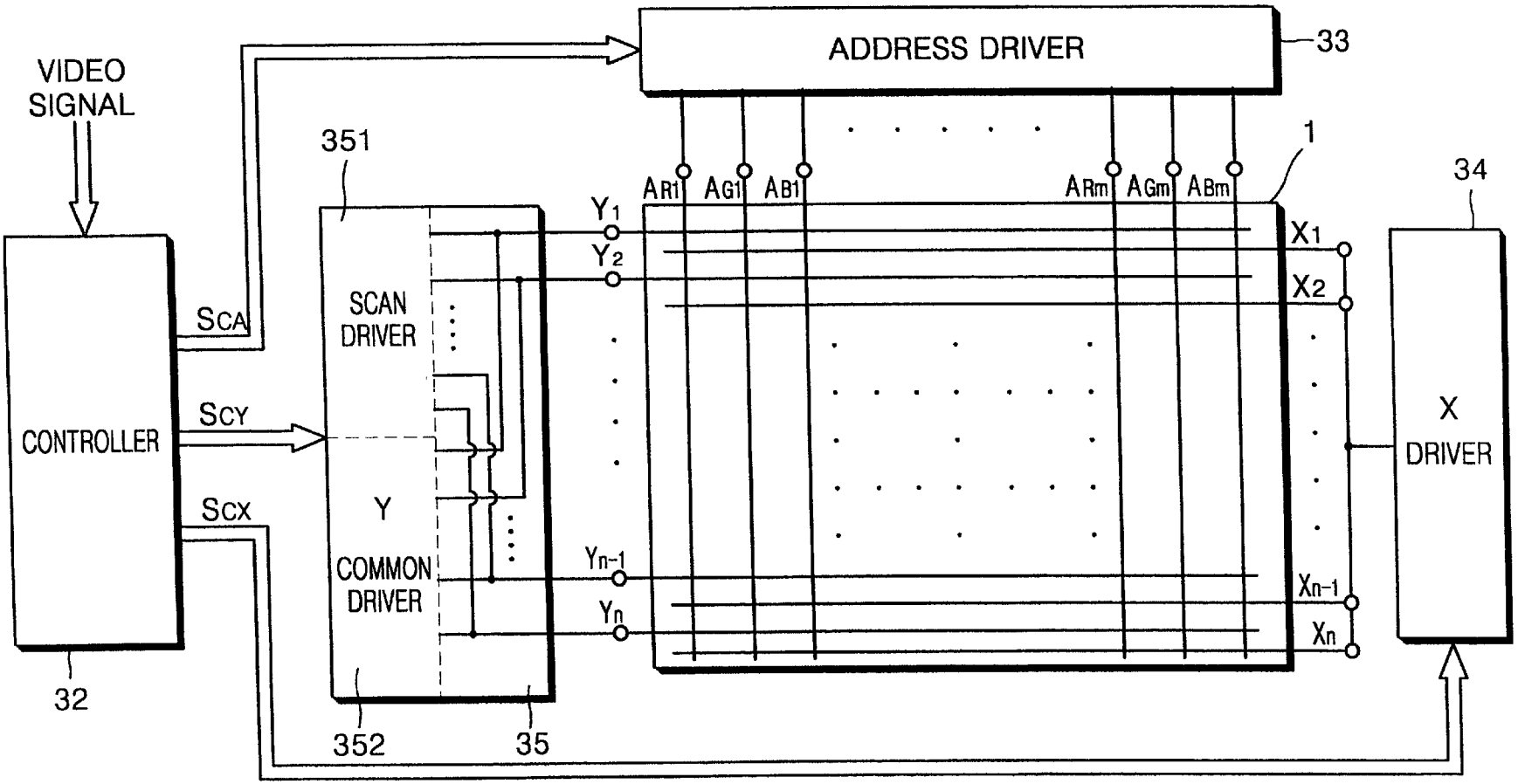
FIG. 3 (PRIOR ART)
FIG. 3 shows a conventional driving apparatus to generate the driving signals shown in FIGS. 2A–E.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 4:
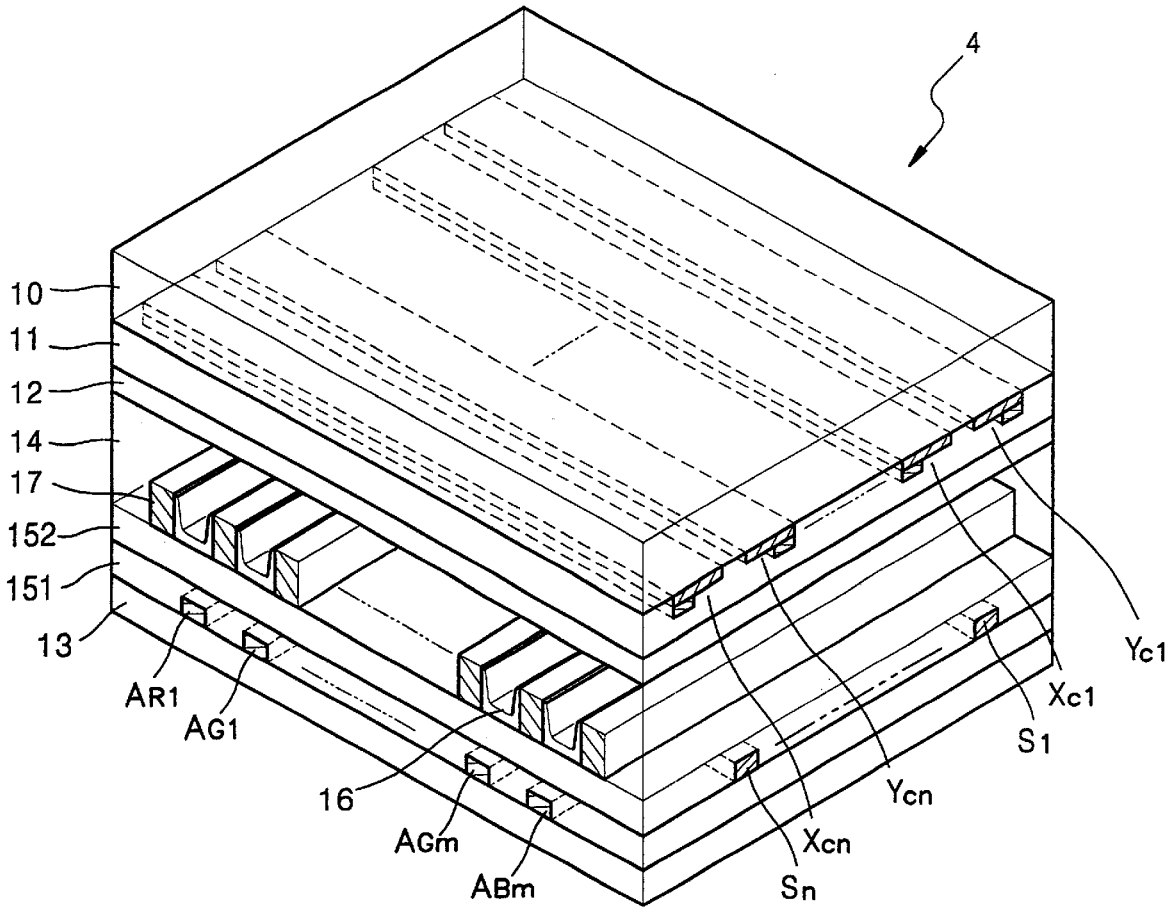
FIG. 4 is an internal perspective view of a four-electrode surface-discharge plasma display panel according to an embodiment of the present invention.
Figure 5:
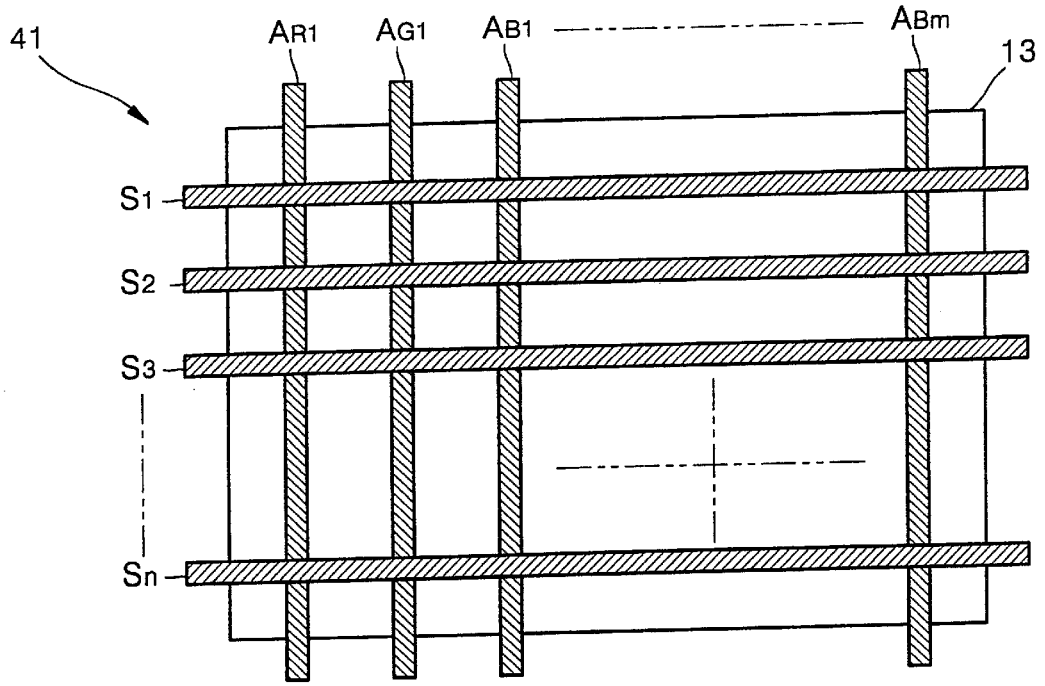
FIG. 5 is a plan view showing the electrode structure of a rear assembly of the plasma display panel shown in FIG. 4.
Figure 6:
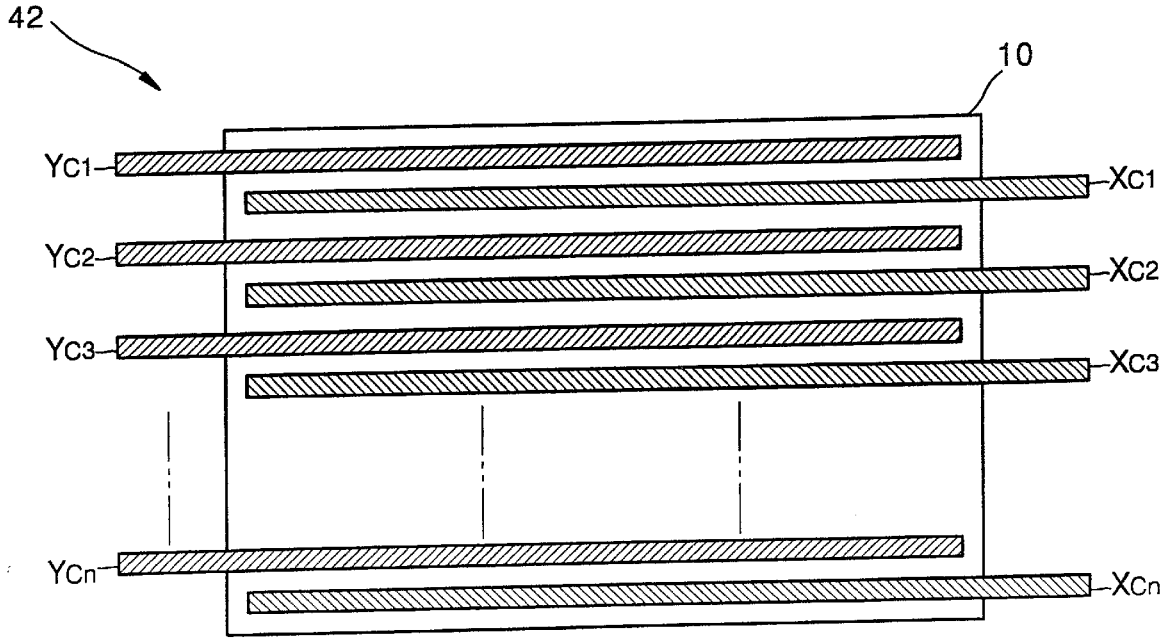
FIG. 6 is a plan view showing the electrode structure of a front assembly of the plasma display panel shown in FIG. 4.
Figure 7:
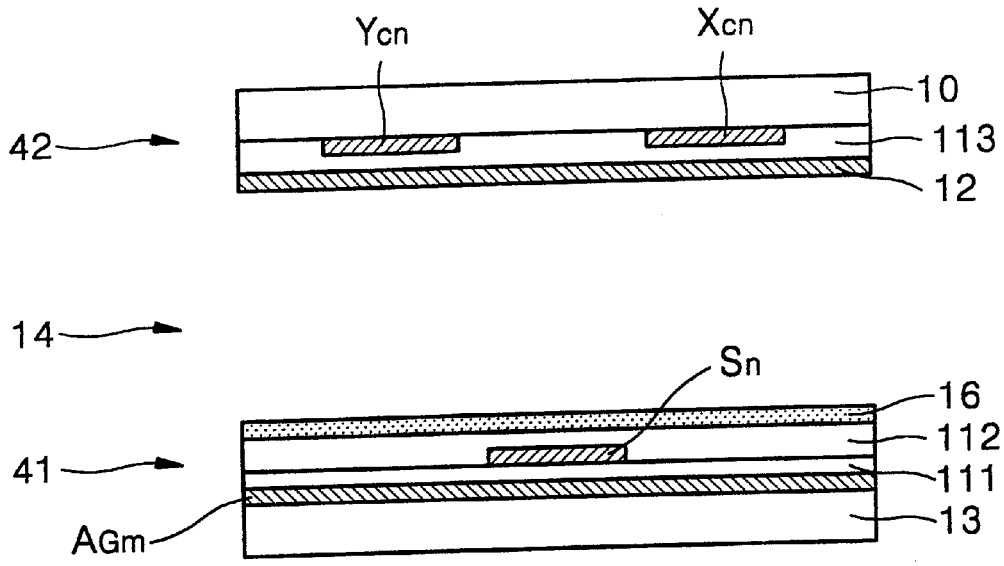
FIG. 7 is a cross sectional view showing the structure of a unit discharge cell of the plasma display panel shown in FIG. 4.

FIG. 4 is an internal perspective view of a four-electrode surface-discharge plasma display panel 4 according to an embodiment of the present invention, FIG. 5 is a plan view showing the electrode structure of a rear assembly 41 of the plasma display panel 4, FIG. 6 is a plan view showing the electrode structure of a front assembly 42 of the plasma display panel 4, and FIG. 7 is a cross sectional view showing the structure of a unit discharge cell of the plasma display panel 4. In FIGS. 4 through 7, the same reference numerals denote the same functional elements.

Referring to FIGS. 4 through 7, the four-electrode plasma display panel 4 includes a front glass substrate 10, a rear glass substrate 13, address electrode lines $A_{R1}$, $A_{G1}$, . . . , $A_{Gm}$, $A_{Bm}$, a first dielectric layer 151, scan electrode lines $S_1$, . . . , $S_n$, a second dielectric layer 152, barrier ribs 17, phosphor layers 16, Y-common electrode lines $Y_{C1}$, . . . , $Y_{Cn}$, X-common electrode lines $X_{C1}$, . . . , $X_{Cn}$, a third dielectric layer 11, a MgO protective film 12 and a discharge space 14.

The front glass substrate 10 and the rear glass substrate 13 are opposite to and spaced apart from each other. The address electrode lines $A_{R1}$, $A_{G1}$, . . . , $A_{Gm}$, $A_{Bm}$ are formed on a front surface of the rear glass substrate 13 in parallel. The first dielectric layer 151 is formed in front of the address electrode lines $A_{R1}$, $A_{G1}$, . . . , $A_{Gm}$, $A_{Bm}$ to cover the address electrode lines $A_{R1}$, $A_{G1}$, . . . , $A_{Gm}$, $A_{Bm}$. The scan electrode lines $S_1$, . . . , $S_n$ are arranged in front of the first dielectric layer 151 to be perpendicular to the address electrode lines $A_{R1}$, $A_{G1}$, . . . , $A_{Gm}$, $A_{B}$m to define discharge cells (see FIG. 7) at interconnections. The second dielectric layer 152 is formed in front of the scan electrode lines $S_1$, . . . , $S_n$ to cover the scan electrode lines $S_1$, . . . , $S_n$. Also, the partition walls 17 are formed in front of the second dielectric layer 152 to be parallel with the address electrode lines $A_{R1}$, $A_{G1}$, . . . , $A_{Gm}$, $A_{Bm}$ disposed between each of the respective partition walls 17. The partition walls 17 define discharge areas of the respective discharge cells and prevent cross talk between each of the respective discharge cells. The phosphor layers 16 are formed between the partition walls 17 formed in front of the second dielectric layer 152 to be parallel with the address electrode lines $A_{R1}$, $A_{G1}$, . . . , $A_{Gm}$, $A_{Bm}$.

The Y-common electrode lines $Y_{C1}$, . . . , $Y_{Cn}$ and the X-common electrode lines $X_{C1}$, . . . , $X_{Cn}$ are alternately arranged on a rear surface of the front glass substrate 10 with the scan electrode lines $S_1$, . . . , $S_n$ interposed therebetween. The third dielectric layer 11 is formed in the rear of the Y-common electrode lines $Y_{C1}$, . . . , $Y_{Cn}$ and the X-common electrode lines $X_{C1}$, . . . , $X_{cn}$. The MgO protective film 12 for protecting the plasma display panel 4 against a strong electric field is formed on a rear surface of the third dielectric layer 12. A gas for forming plasma is hermetically sealed in a discharge space 14 between the rear assembly 41 and the front assembly 42.

According to the aforementioned plasma display panel 4, the address electrode lines $A_{R1}$, $A_{G1}$, . . . , $A_{Gm}$, $A_{Bm}$ in the rear assembly 41 and the scan electrode lines $S_1$, . . . , $S_n$ are driven to select the discharge cells to be displayed, and the Y-common electrode lines $Y_{C1}$, . . . , $Y_{Cn}$ and the X-common electrode lines XC1, . . . , Xcn are driven to display the selected discharge cells. Accordingly, since the scan electrode lines $S_1$, . . . , $S_n$ and the Y-common electrode lines $Y_{C1}$, . . . , $Y_{Cn}$ are independently driven, the power regeneration efficiency of the plasma display panel 4 can be enhanced and the power consumption and heat emission of the driving apparatus thereof can be reduced.

Figure 9:
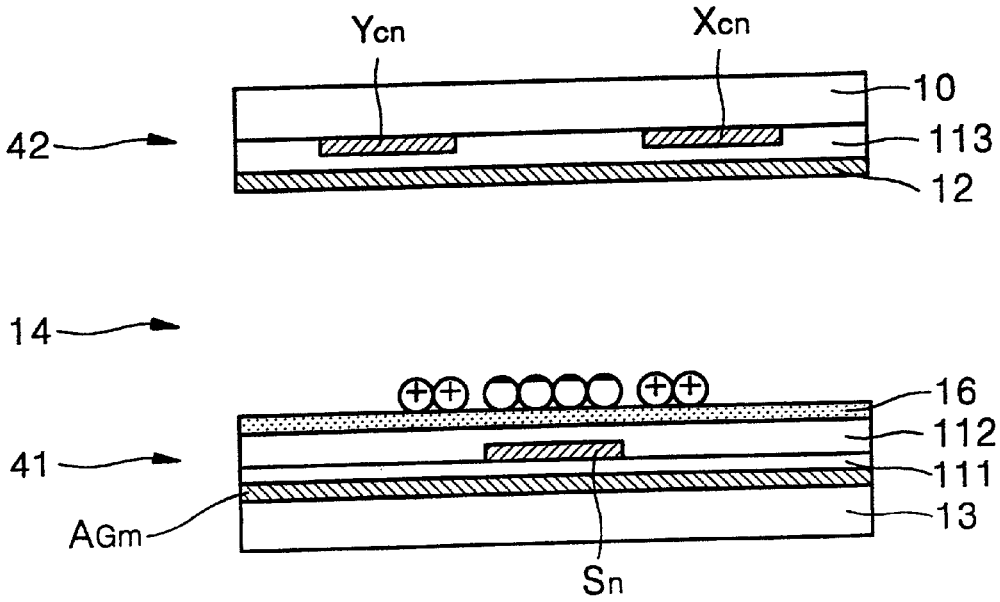
FIG. 9 is a cross sectional view showing the state in which wall charges are formed in selected discharge cells after a main address period shown in FIGS. 8A–8F is completed.
Figures 8A, 8B, 8C, 8D, 8E, 8F:
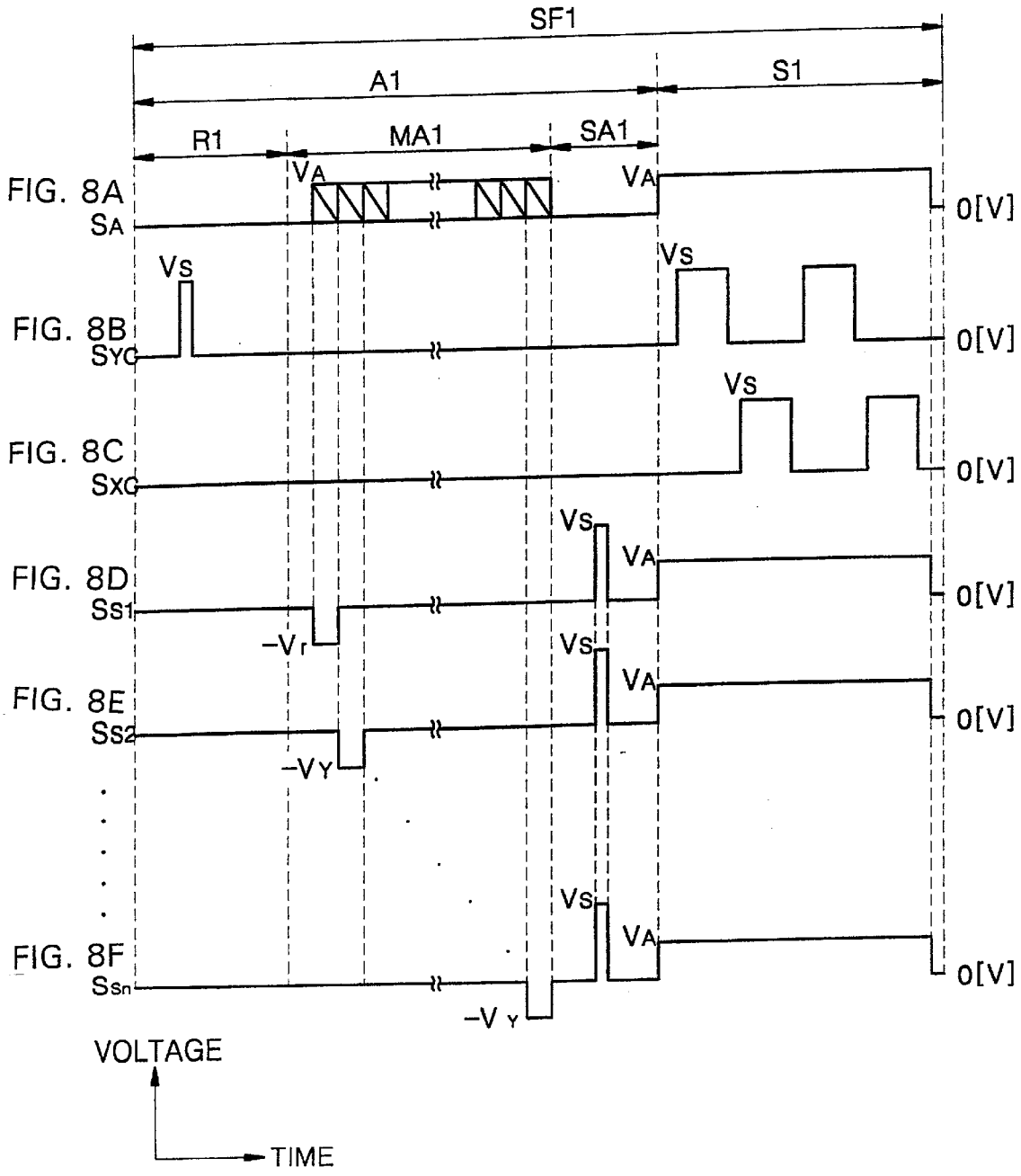
FIGS. 8A–8F are timing diagrams showing driving signals applied to the plasma display panel shown in FIG. 4.
Figure 10:
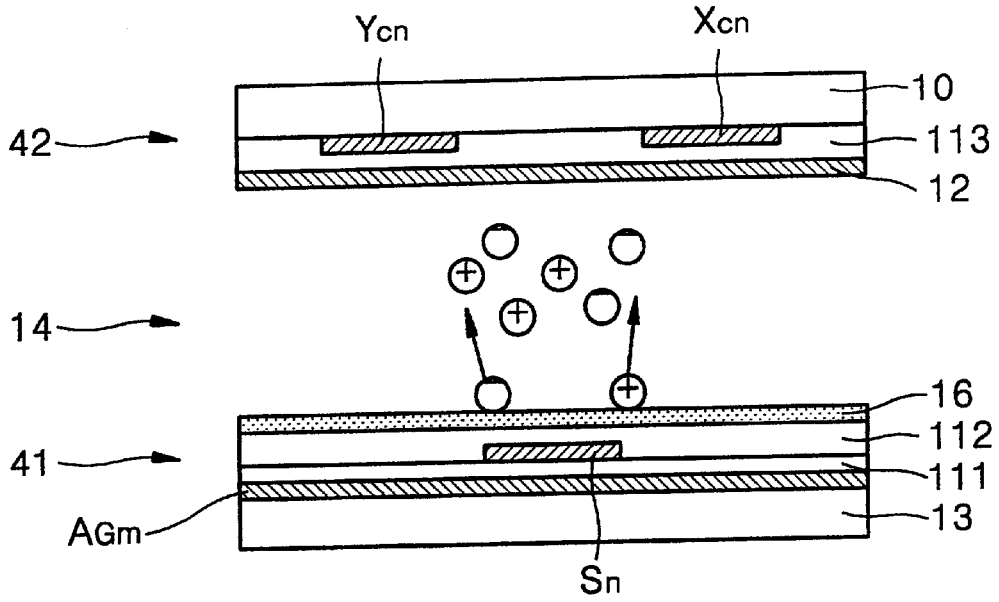
FIG. 10 is a cross sectional view showing the state in which the wall charges of the selected discharge cells are changed into space charges during an auxiliary address period shown in FIGS. 8A–8F.
Figure 11:
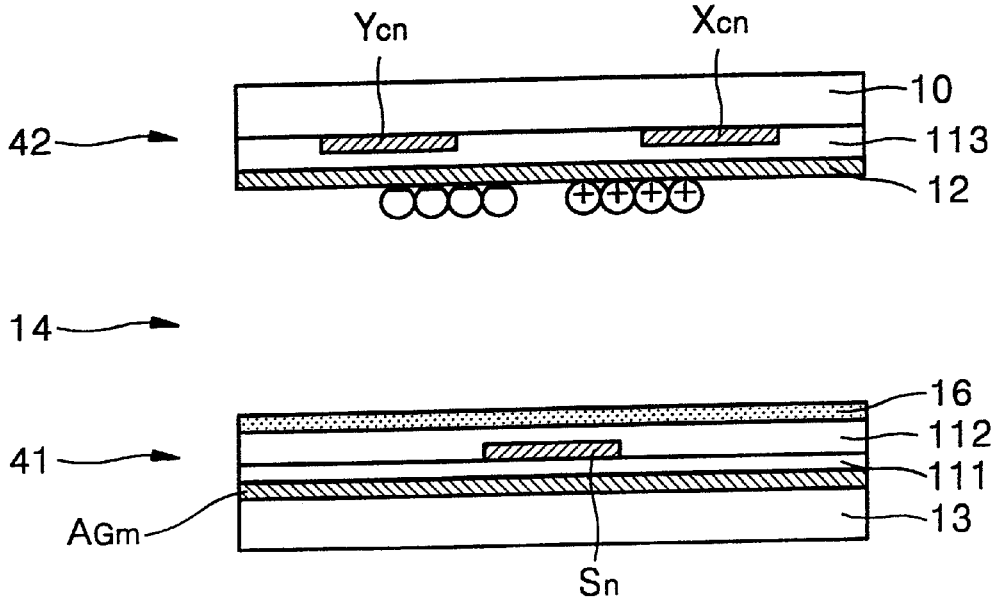
FIG. 11 is a cross sectional view showing the state in which the first display discharge is performed in a selected discharge cell during a display discharge period shown in FIGS. 8A–8F.

FIGS. 8A–8F show driving signals applied to the plasma display panel 4 shown in FIG. 4, FIG. 9 shows the state in which wall charges are formed in selected discharge cells after a main address period MA1 shown in FIGS. 8A–8F is completed, FIG. 10 shows the state in which the wall charges of the selected discharge cells are changed into space charges during an auxiliary address period SA1 shown in FIGS. 8A–8F, and FIG. 11 is a cross sectional view showing the state in which the first display discharge is performed in a selected discharge cell during a display discharge period S1 shown in FIGS. 8A–8F. In FIGS. 9 through 11, the same reference numerals denote the same functional elements.

In FIGS. 8A–8F, SA (FIG. 8A) denotes driving signals applied to the respective address electrode lines ($A_{R1}$, $A_{G1}$, . . . , $A_{Gm}$, $A_{Bm}$ of FIG. 4), SYC (FIG. 8B) denotes driving signals applied to the Y-common electrode lines ($Y_{C1}$, . . . , $Y_{Cn}$ of FIG. 4), $S_{XC}$ (FIG. 8C) denotes driving signals applied to the X-common electrode lines ($X_{C1}$, . . . , $X_{Cn}$ of FIG. 4), and $S_{S1}$, . . . , $S_{Sn}$ (FIG. 8D–8F) denote driving signals applied to the scan electrode lines ($S_1$, . . . , $S_n$ of FIG. 4), respectively. Referring to FIGS. 8A–8F, a unit subfield SF1 is divided into an address period A1 and display discharge period S1. The address period A1 includes a reset period R1, a main address period MA1 and an auxiliary address period SA1. Here, while the length of the address period A1 is constant irrespective of gray scales, the length of the display discharge period S1 is set to be proportional to the gray scales.

As shown in FIGS. 8A–8F, when the last pulse of the display discharge period S1 is applied to the X-common electrode lines $X_{C1}, \ldots, X_{cn}$, electrons concentrate around the X-common electrodes of the discharge cells selected in the main address period MA1 and cations concentrate around the Y-common electrodes. Thus, in the reset period R1, an erase pulse of a voltage $V_S$ which has the same magnitude as and a narrower pulse width than the pulse for display discharge, is applied to the Y-common electrode lines $Y_{C1}, \ldots, Y_{Cn}$. As the erase pulse is applied, the electrons around the X-common electrodes of the discharge cells which have performed display discharges, migrate toward the Y-common electrodes and the cations around the Y-common electrodes migrate toward the X-common electrodes. The migrating electrons and cations are neutralized to then be erased. Also, any remaining electrons and cation exist as space charges in the discharge space 14 of FIGS. 4 or 7, so that they assist the function of the subsequent main address period MA1.

In the main address period MA1, while a negative scan pulse, $-V_Y$ is sequentially applied to the scan electrode lines $S_1, \ldots, S_n$, the corresponding display data signal $S_A$ is applied to the address electrode lines $A_{R1}, A_{G1}, \ldots, A_{Gm}, A_{Bm}$. The display data signal $S_A$ has a positive voltage $V_A$ with respect to the selected address electrode lines. Accordingly, wall charges are formed in front of the phosphor layers 16 of the selected discharge cells as shown in FIG. 9.

In the auxiliary address period SA1, the erase pulse of a voltage $V_S$ which has the same magnitude as and a narrower pulse width than the pulse for display discharge, is applied to the scan electrode lines $S_1, \ldots, S_n$. Accordingly, the wall charges formed in the main address period MA1 migrate toward the Y-common electrode lines and X-common electrode line, so that abundant space charges exist in the selected discharge cells as shown in FIG. 10.

In the display discharge period S1, a pulse of a positive voltage $V_S$, for display discharge, is alternately applied to the Y-common electrode lines $Y_{C1}, \ldots, Y_{Cn}$ and the X-common electrode lines $X_{C1}, \ldots, X_{Cn}$. Thus, display discharges occur at discharge cells where abundant space charges are formed during the auxiliary address period SA1 as shown in FIG. 11. Here, a bias voltage $V_A$ lower than the display discharge pulse and having the same polarity is consistently applied to the scan electrode lines $S_1, \ldots, S_n$, thereby suppressing migration of charges toward the scan electrode lines $S_1, \ldots, S_n$. Accordingly, the display discharge efficiency can be enhanced.

Figure 12:
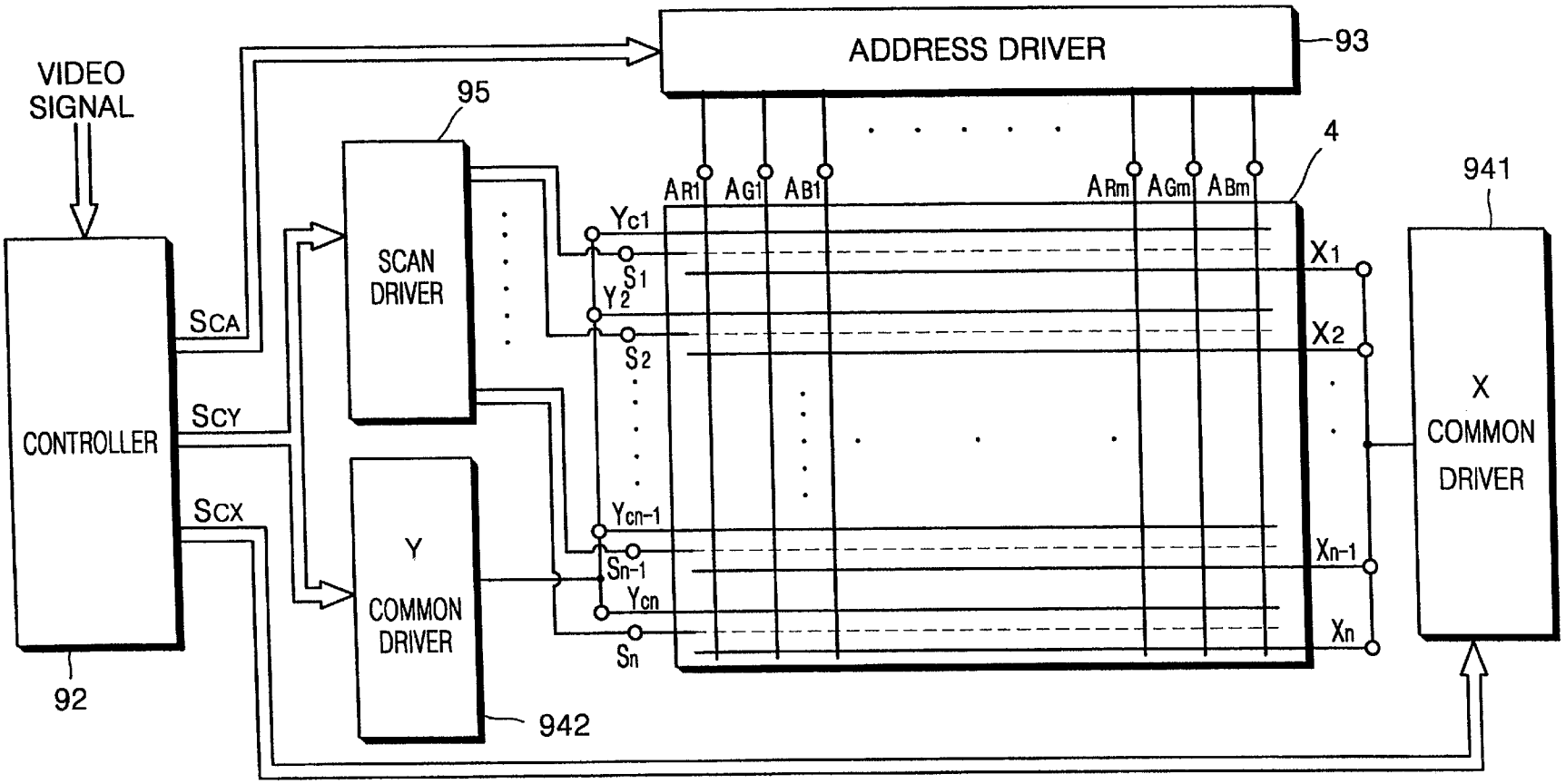
FIG. 12 shows a driving apparatus according to an embodiment of the present invention to generate the driving signals shown in FIGS. 8A–8F.

FIG. 12 shows a driving apparatus to generate the driving signals shown in FIGS. 8A–F. The driving apparatus of the plasma display panel 4 according to the present invention includes a controller 92, an address driver 93, an X-common driver 941, a scan driver 95 and a Y-common driver 942. The controller 92 generates driving control signals $S_{CA}$, $S_{CY}$ and $S_{CX}$ in accordance with an external video signal. The address driver 93 processes the address driving control signal $S_{CA}$ among the driving control signals $S_{CA}$, $S_{CY}$ and $S_{CX}$ generated by the controller 92 and applies the resultant display data signal ($S_A$ of FIG. 8A) to the address electrode lines $A_{R1}, A_{G1}, \ldots, A_{Gm}, A_{Bm}$. The X-common driver 941 generates a driving signal ($S_{XC}$ of FIG. 8C) to be applied to the X-common electrode lines $X_{C1}, \ldots, X_{Cn}$ in accordance with the X driving control signal $S_{CX}$ among the driving control signals $S_{CA}$, $S_{CY}$ and $S_{CX}$ generated by the controller 92. The scan driver 95 generates driving signals ($S_{S1}, \ldots, S_{Sn}$ of FIGS. 8D–F) to be applied to the scan electrode lines $S_1, \ldots, S_n$ in accordance with the Y driving control signal $S_{CY}$ among the driving control signals $S_{CA}$, $S_{CY}$ and $S_{CX}$ generated by the controller 92. The Y-common driver 942 generates a driving signal ($S_{YC}$ of FIG. 8B) to be applied to the Y-common electrode lines $Y_{C1}, \ldots, Y_{Cn}$ in accordance with the Y driving control signal $S_{CY}$ among the driving control signals $S_{CA}$, $S_{CY}$ and $S_{CX}$ generated by the controller 92.

The X-common driver 941 and the Y-common driver 942 withdraw any unnecessary power from the discharge cells displayed in the current pulse period when the pulse of $V_S$ for display discharge is periodically applied to the X electrode lines $X_1, \ldots, X_n$ and the Y electrode lines Y1, . . . , Yn, and apply the withdrawn power to discharge cells to be displayed in a subsequent pulse period.

In the driving apparatus of the aforementioned plasma display panel, since the scan driver 95 and the Y-common driver 942 can be independently driven, the number of elements thereof is reduced, and connection elements thereof are not necessary. Accordingly, the power consumption of the scan driver 95 and the Y-common driver 942 is reduced and the power regeneration efficiency of the Y-common driver 942 is enhanced accordingly.

As described above, in the four-electrode plasma display panel according to the present invention and the driving method and apparatus thereof, the address electrodes lines and the scan electrode lines are driven to select the discharge cells to be displayed, and the Y-common electrode lines and the X-common electrode lines are driven to display the selected discharge cells. Accordingly, since the scan electrode lines and the Y-common electrodes lines are independently driven, the power regeneration efficiency of the plasma display panel can be enhanced and the power consumption and heat emission of the driving apparatus can be reduced.

Although the invention has been described with respect to a preferred embodiment, it is not to be so limited as changes and modifications can be made which are within the full-intended scope of the invention as defined by the appended claims, which is defined in the claims and their equivalents.

What is claimed is:

1. A plasma display panel comprising:

a front glass substrate;

a rear glass substrate opposite to and spaced apart from said front glass substrate;

address electrode lines on a front surface of said rear glass substrate, said address electrodes lines being parallel to each other;

a first dielectric layer formed in front of said address electrode lines;

scan electrode lines arranged in front of said first dielectric layer to be perpendicular to said address electrode lines;

a second dielectric layer formed in front of said scan electrode lines;

phosphor layers formed in front of said second dielectric layer to be parallel with said address electrode lines; and Y-common electrode lines and X-common electrode lines alternately arranged on a rear surface of said front glass substrate with each said scan electrode line between but not coplanar with adjacent pairs of said Y-common and X-common electrode lines.

2. A method of driving a plasma display panel comprising a front glass substrate and a rear glass substrate opposite to and spaced apart from each other, address electrode lines formed on a front surface of the rear glass substrate in parallel, a first dielectric layer formed in front of the address electrode lines, scan electrode lines arranged in front of the first dielectric layer to be perpendicular to the address electrode lines, a second dielectric layer formed in front of the scan electrode lines, phosphor layers formed in front of the second dielectric layer to be parallel with the address electrode lines, and Y-common electrode lines and X-common electrode lines alternately arranged on a rear surface of the front glass substrate with the scan electrode lines interposed therebetween, the method comprising:

forming wall charges in front of the phosphor layers of selected discharge cells while a scan pulse is sequentially applied to the corresponding scan electrode lines and a display data signal is applied to the address electrode lines;

producing space charges in the selected discharge cells by causing the formed wall charges to migrate toward the Y-common electrode lines and X-common electrode lines;

causing a display discharge after said producing the space charges by applying a pulse for display discharge alternately to the Y-common electrode lines and the X-common electrode lines to cause the display discharge to be performed at discharge cells where space charges are formed;

after said causing said display discharge, uniformly distributing the space charges of all discharge cells while erasing the space charges present around the Y-common electrodes and X-common electrodes of the discharge cells where the display discharges have been performed; and repeating said forming wall charges, said producing space charges, said causing the display discharge, and said distributing the space charges.

3. The method according to claim 2, wherein said producing the space charges comprises forming the space charges in the selected discharge cells by applying an erase pulse having an opposite polarity to and a narrower width than the scan pulse, to the scan electrode lines.

4. The method according to claim 2, wherein said causing the display discharge comprises suppressing migration of the space charges toward the scan electrode lines by consistently applying a bias voltage having the same polarity as and a lower magnitude than the display discharge pulse, to the scan electrode lines.

5. An apparatus for driving a plasma display panel comprising a front glass substrate and a rear glass substrate opposite to and spaced apart from each other, address electrode lines formed on a front surface of the rear glass substrate in parallel, a first dielectric layer formed in front of the address electrode lines, scan electrode lines arranged in front of the first dielectric layer to be perpendicular to the address electrode lines, a second dielectric layer formed in front of the scan electrode lines, phosphor layers formed in front of the second dielectric layer to be parallel with the address electrode lines, and common electrode lines and X-common electrode lines alternately arranged on a rear y-surface of the front glass substrate with the scan electrode lines interposed therebetween, the apparatus comprising:

a controller to generate driving control signals in accordance with an external video signal;

an address driver to process an address driving control signal among the driving control signals generated by said controller and to apply display data signals to the address electrode lines;

an X-common driver to drive the X-common electrode lines in accordance with an X driving control signal among the driving control signals generated by said controller;

a scan driver to drive the scan electrode lines in accordance with a Y driving control signal among the driving control signals generated by said controller; and a Y-common driver to drive the Y-common electrode lines in accordance with the Y driving control signal.

6. A plasma display panel, comprising:

a front assembly comprising X-common and Y-common electrode lines;

a rear assembly comprising address electrode lines and scan electrode lines, where the scan electrode lines are perpendicular to but not coplanar with the address electrode lines; and a discharge area between said front assembly and said rear assembly, said discharge area comprising discharge cells that discharge in accordance with discharge voltages applied to the X-common and Y-common electrode lines.

7. An apparatus for driving a plasma display panel in accordance with an external video signal, comprising:

a front assembly comprising X-common and Y-common electrode lines;

a rear assembly comprising address electrode lines and scan electrode lines, where the scan electrode lines are perpendicular to but not coplanar with the address electrode lines;

a discharge area between said front assembly and said rear assembly, said discharge area comprising discharge cells;

a controller to generate an address driving control signal, an X driving control signal, and a Y driving control signal in accordance with the external video signal;

an address driver to process the address driving control signal and to apply display data signals to address electrode lines in accordance with the address driving control signals;

an X-common driver to drive the X-common electrode lines in accordance with the X driving control signal to discharge the discharge cells;

a scan driver to drive the scan electrode lines in accordance with the Y driving control signal; and a Y-common driver to drive the Y-common electrode lines in accordance with the Y driving control signal to discharge the discharge cells.

8. A method of driving a plasma display panel having display cells, comprising:

forming wall charges on a back side of the display cells using scan electrode lines and address electrode lines;

forming space charges by moving the wall charges from the back side toward a front side of the display cells using the scan electrode lines; and causing a display discharge in the discharge cells having the space charges using X-common and Y-common electrode lines and the scan electrode lines.

9. A plasma display panel, comprising:

discharge cells in a discharge area;

X and Y common electrode lines adjacent to the discharge area where said X and Y electrode lines are driven to discharge said discharge cells; and scan and address electrode lines located adjacent to the discharge area and opposite to said X and Y common electrode lines where said scan electrode lines and address electrode lines are driven to prepare said discharge cells prior to discharge, wherein said scan electrode lines and said Y common electrode lines are driven independently.

10. An apparatus to drive a plasma display panel having a discharge area, X and Y common electrode lines adjacent to the discharge area, and scan and address electrode lines adjacent to the discharge area opposite the X and Y common electrode lines, the apparatus comprising:

a controller to receive a video signal and to produce X and Y driving signals, scan signals, and address signals;

an X common driver and a Y common driver to drive the X and Y common electrode lines in accordance with the X and Y driving signals; and scan and address drivers to drive the scan and address electrode lines in accordance with the scan and address signals, wherein said scan driver and said Y common driver drive the scan electrode lines and said Y common electrode lines independently.

* * * * *